United States Patent [19]

Jackson

[11] 4,362,398

[45] Dec. 7, 1982

[54] MULTIPLEXED LCD ANALOG TIMEPIECE

[75] Inventor: Michael Jackson, San Jose, Calif.

[73] Assignee: Timex Corporation, Waterbury, Conn.

[21] Appl. No.: 197,060

[22] Filed: Oct. 14, 1980

[51] Int. Cl.[3] ..... G04C 17/02

[52] U.S. Cl. ..... 368/240; 368/242

[58] Field of Search ..... 368/82, 84, 239, 240, 368/242; 340/756, 765, 802

[56] References Cited

U.S. PATENT DOCUMENTS

| | | | |
|---|---|---|---|
| 4,076,385 | 2/1978 | Kondo | 340/765 X |
| 4,110,967 | 9/1978 | Fujita | 368/84 |
| 4,242,747 | 12/1980 | Fahrenschon | 368/242 |
| 4,254,488 | 3/1981 | Ojima et al. | 368/82 |
| 4,312,055 | 1/1982 | Noble | 368/240 |
| 4,555,806 | 3/1982 | Fahrenschon et al. | 368/240 |

*Primary Examiner*—Vit W. Miska

*Attorney, Agent, or Firm*—William C. Crutcher; Joseph A. Biela

[57] ABSTRACT

An LCD analog timepiece employs a multiplexing driving circuit to supply voltages to the liquid crystal display segments in the proper sequential relationship so as to activitate the desired portions of the display in time-multiplex fashion to show hours, minutes and seconds. The multiplex driving circuit connects a minimum number of combinations of simple waveforms in proper phase to one or more of 16 strings of radial segments and to one or more of 8 backplane segments in a prescribed manner. Special radial segments are located so as to straddle the juncture of the backplane segments, in order to simplify circuit connections for using an hour hand which appears to be three segments wide.

10 Claims, 20 Drawing Figures

MULTIPLEXED LCD ANALOG TIMEPIECE

This invention relates to a multiplexing LCD analog timepiece, and more particularly to improvements in the driving circuit and the arrangement and grouping of conductive elements on the display to provide an improved LCD analog timepiece.

Some of the earliest application of liquid crystal displays in timepieces were suggested in the form of moving radial "hands" rather than digits to simulate mechanical timepieces, as suggested in U.S. Pat. No. 3,540,209 issued Nov. 17, 1970 to N. Zatsky and E. Keeler. This patent suggested an 8×8 segment matrix (eight connections for the radial hands, and eight connections to one ring of backplane sectors) multiplexed on a 50% duty cycle to distinguish hours and minutes, and also suggested depicting hours, seconds and minutes on the same display. Improvements in the arrangement of the segments on the display substrates so as to provide the necessary circuit interconnections of the hands without crossover of the connecting leads is now known in the art and is disclosed in a co-pending application Ser. No. 556,758 filed in the name of L. Weisner on Mar. 10, 1975. This arrangement for interconnecting the radial segments in sets of strings, in sequentially ascending and descending order around the face of the timepiece, reduces the number of contact terminals and is adaptable for multiplexing. The arrangement has since been shown in a number of issued patents, such as U.S. Pat. No. 3,969,887 issued July 20, 1976 to Fukumoto, U.S. Pat. No. 3,934,241 issued Jan. 20, 1976 to Weigert.

A number of patents have suggested multiplexing or time sharing between display of a long radial marker for minutes and a short radial marker for hours by displaying first one and then the other at a sufficiently high frequency so that the eye views both hands at once. Such is suggested in the aforementioned Fukumoto and Weigert patents, as well as in the following exemplary patents: U.S. Pat. Nos. 3,844,105 issued Oct. 29, 1974 to Kashio; 3,955,354 issued May 11, 1976 to Kilby et.al.; 3,959,963 issued June 1, 1976 to Murrell, these being exemplary of the prior art, but not necessarily all inclusive.

One of the problems in driving and multiplexing liquid crystal displays of any sort is to activate the desired pairs of segments on the front and back substrates so that they are visible, without activating the undesired pairs of segments. For example, it is recognized in U.S. Pat. No. 3,932,860 issued to S. Cohen on Jan. 13, 1976 that use can be made of the threshhold properties of a liquid crystal, wherein the driving circuit is arranged such that voltages above the threshhold voltage are applied to some segments and voltages below the threshold voltage to the remainder. U.S. Pat. No. 3,653,745 issued to Mao on Apr. 4, 1972 and U.S. Pat. No. 3,781,864 issued to Fujita on Dec. 25, 1973 both disclose that two alternating square wave signals of opposite phase applied to the two opposed segments of the display cause the display to "see" a root mean square voltage determined by the difference between the waveforms.

A number of schemes have been advanced for driving and multiplexing liquid crystal displays by means of selection of voltages and their phase relationships. For example, U.S. Pat. No. 3,973,252 scans an LCD matrix display using a driving method in which voltages on the X lines and Y lines are varied along with the length of the address period and nonaddress period. U.K. published patent application GB No. 2,019,048A describes three level, phase displaced waveforms to drive a 5×24 matrix arranged as an analog display. U.K. published patent application GB No. 2,011,143A drives a 10×20 matrix arranged as an analog display using four square wave signals to provide four different combinations of energization states. Also, the aforementioned Fukumoto U.S. Pat. No. 4,079,369 uses a combination of three waveforms on the backplane and two waveforms on the front segments to drive the display segments with six combinations of waveforms. Another analog timepiece with liquid crystal display using a 10×20 matrix is shown in U.S. Pat. No. 4,209,974 issued July 1, 1980 to R. Noble. This patent uses four phase displaced waveforms of two discrete signal levels on the back planes and four phase displaced waveforms of three discrete signal levels on the radial segments. The waveforms are sequentially gated to the appropriate electrodes to display the desired time information. This patent requires additional decoding to handle the situation where a shorthand and a longhand share a back plane, and employs two levels of multiplexing.

The aforementioned exemplary arrangements are somewhat cumbersome because of the number and complexity of waveforms needed and variation of address and nonaddress times, in order to prevent undesired activation of adjacent or opposed display segments.

A very important aesthetic consideration for an LCD analog timepiece is the situation of crossover of a minute hand and an hour hand. Although this takes place smoothly on a watch with mechanical hands, present electro-optic displays do not have the capability of continuous hand movement but must jump from one position to the next. Since the segments are used for both hands, some method must be devised to distinguish the hour hand from the minute hand. In some cases this has been done by using special shaped hands as exemplified in U.S. Pat. No. 3,823,549 issued July 16, 1974 to D. Feldman and in U.S. Pat. No. 4,077,032 issued Feb. 28, 1978 to A. Volkman. In other cases, hour hands have been distinguished from minute hands by keeping them separated in concentric circles, as illustrated in U.S. Pat. No. 3,969,887 issued July 20, 1976 to Fukumoto or U.S. Pat. No. 3,987,616 issued Oct. 26, 1976 to A. Slob. In still other cases the hour hand is distinguished buy using more than one radial segment on the inner part of the dial and a single radial segment on the outer part of the dial as shown in U.K. published application GB No. 2,011,143A mentioned previously. A problem is encountered when two or more radial segments are used to show the hour hand. This problem occurs at the juncture between the common or back plane electrodes. Under one common type of electrode connection typified in the aforementioned pending Wiesner application Ser. No. 556,758, it is not convenient to activate radial segments on both back planes without going to a multiplexing scheme. The undesirable alternative to multiplexing is to cause the hour hand to "wait" at the juncture between back planes for one or more sequencing intervals and then "jump over" the juncture. As mentioned, one way to avoid this problem is to multiplex. However, if hours, minutes and seconds hands are already sharing a portion of the cycle time (multiplex level of 3), the addition of another level of multiplexing is not desirable.

Many integrated circuits today are designed using data bytes of 4, 8 or 16 bits of information. It would be useful to drive a multiplexed LCD analog from an 8×16 matrix, in order to make the most efficient use of a 4, 8 or 16 bit device. It is also desirable to utilize only simple two level waveforms in a minimum number of combinations to drive the display.

Accordingly, one object of the present invention is to provide an improved LCD analog timepiece.

Another object of the invention is to provide an improved multiplexing driving circuit for the display in an LCD analog timepiece.

Another object of the invention is to provide an improved LCD analog display and associated multiplexing drive circuit for an LCD analog timepiece.

DRAWINGS

The invention, both as to organization and method of practice, together with further objects and advantages thereof, will best be understood by reference to the following specification, taken in connection with the accompanying drawings, in which:

FIG. 1 is a simplified schematic diagram of an LCD analog timepiece,

FIG. 2 is a circuit diagram for a waveform generator associated with the driving circuit, FIG. 3 is a waveform diagram of the output of the wave generator, FIG. 4 is a waveform diagram of combined waveforms from FIG. 3, FIG. 5 is a schematic of an integrated circuit drive device for one display electrode, FIG. 6 is a simplified schematic diagram of the microprocessor control system, FIG. 7 is a diagram showing the sequence of activating the electrodes of the LCD display for the minutes/seconds hand, FIG. 8 is a diagram showing the sequence of activating the display electrodes for the hour hand, FIG. 9 is a developed view of the electrical circuit matrix for the display, FIG. 10 is an enlarged view of the backplane electrodes with connecting leads and terminals, FIG. 11 is a corresponding plan view of the radial electrodes on the front substrate, with connecting leads and terminals, FIG. 12 is an enlarged view of one portion of the LCD analog display, and FIGS. 12*a*–12*e* is a reduced-size view of FIG. 12 illustrating a typical sequence of times at one minute intervals, showing the crossover of minute hand with hour hand.

SUMMARY OF THE INVENTION

Briefly stated, the invention comprises improvements in an LCD analog timepiece of the type having a time base with quartz oscillator and countdown divider providing timekeeping pulses and display driving pulses for a liquid crystal display with sector-shaped backplane electrodes and radial electrodes interconnected in strings in a known fashion for multiplexing drive. A multiplexer selectively applies pairs of four waveforms from a waveform generator. A low voltage square wave or a low voltage square wave in inverse phase relationship is applied to electrodes on one substrate while a reference voltage or a high voltage square wave is applied to opposed electrodes. Only one pair of waveforms will combine to activate opposed electrodes, while any other comnbination of the waveforms will not activate display electrodes. The juncture between inner backplane sectors is "straddled" by a radial electrode to provide half-width markers at the transition point. Three inner radial markers are used for the hour hand, except at the transition where $2\frac{1}{2}$ radial segments are used.

DESCRIPTION OF THE PREFERRED EMBODIMENT

Figure 1:
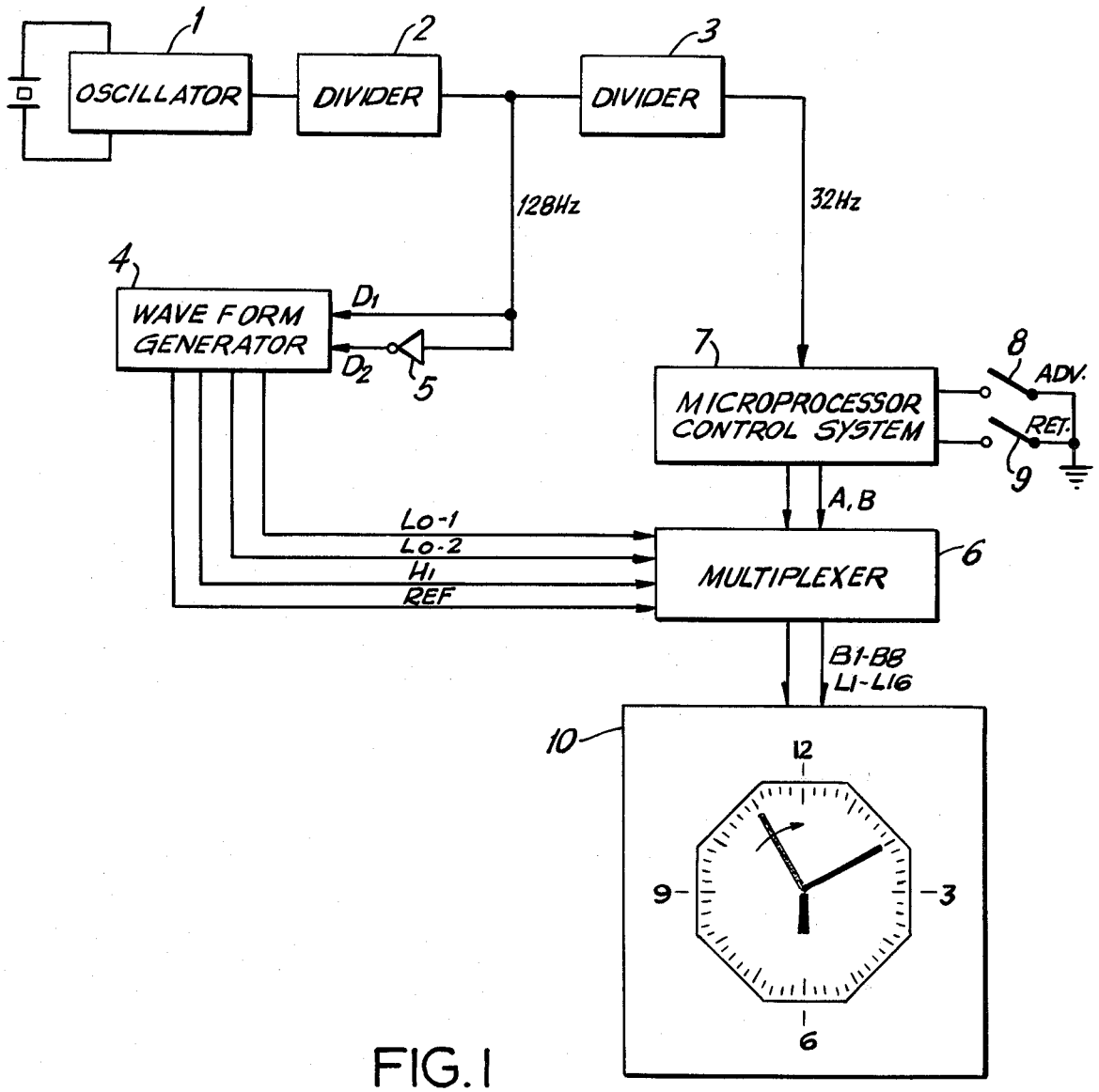

FIG. 1 is a simplified schematic drawing wherein an accurate quartz-controlled time base of conventional design is provided by means of conventional quartz crystal oscillator 1 serving as a time base with output frequency of 32, 768 Hz serves as a source of electrical signals with predetermined repetition rates connected to a countdown divider chain 2 which reduces the output frequency to 128 Hz supplying another countdown divider chain 3 dividing the frequency to 32 Hz. The 128 Hz signal designated $D_1$ is supplied to a wave form generator 3 and to an inverter 5. Inverter 5 supplies a signal $D_2$ to the waveform generator. Signals $D_1$ and $D_2$ control the display drive frequency.

Four output signals designated LO-1, LO-2, HI and REF are coupled from the waveform generator 4 to a multiplex driver 6. The 32 Hz signal from divider 3 is the timekeeping signal and serves as an input to a microprocessor control system 7 which is coupled to the multiplex driver 6 over an output bus. External manually actuated switches 8, 9 control advance and retard of the timepiece for setting purposes.

The multiplex driver 6 is connected to a LCD analog display 10 over a multiplexing output bus which carries time-sequenced signals of the appropriate phase and magnitude to the electrodes on the LCD display substrates.

Figure 2:
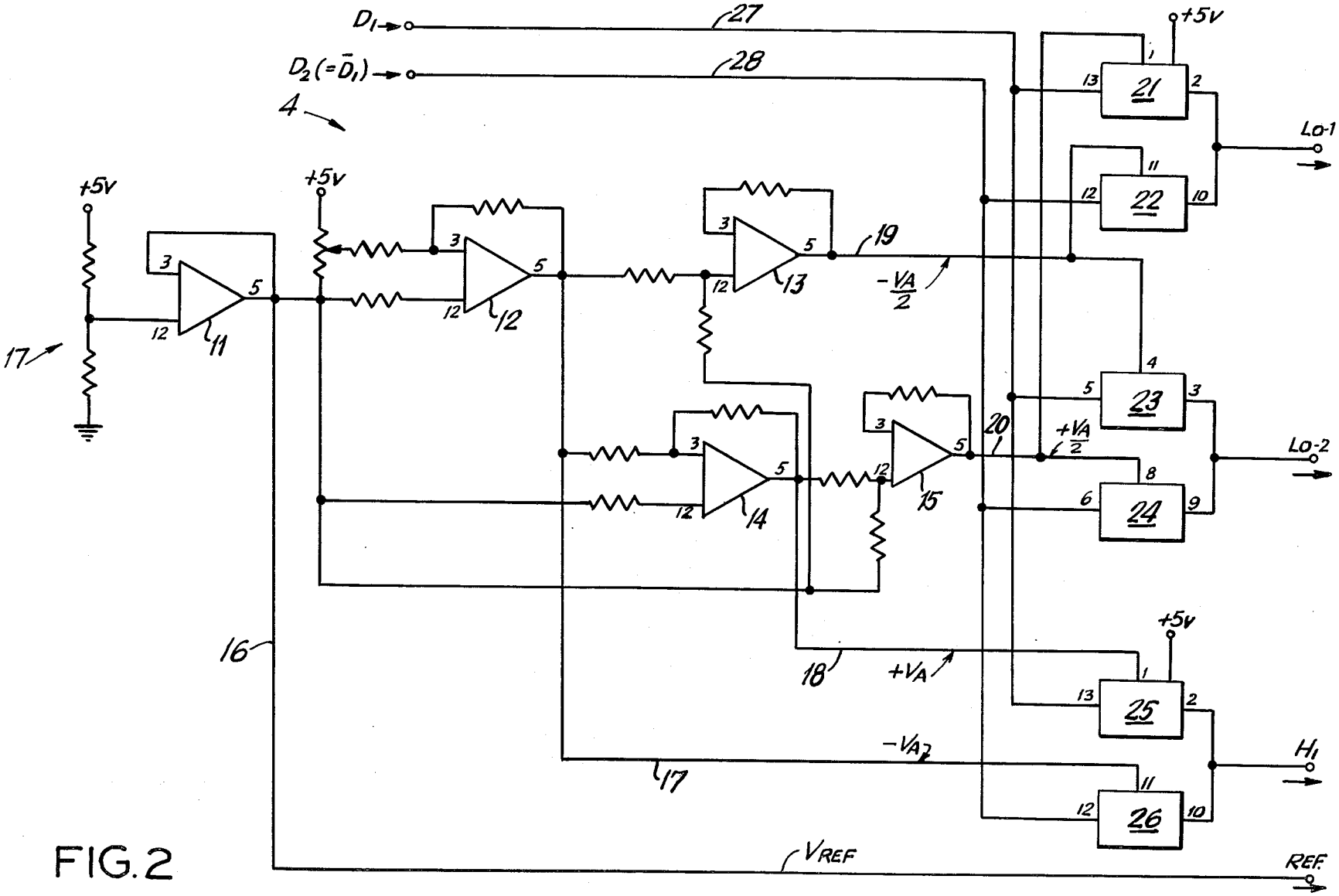

Referring to FIG. 2 of the drawing, a circuit suitable for the wave form generator 4 is illustrated. Voltage levels of the proper magnitude are generated by operational amplifiers 11, 12, 13, 14, 15 connected as shown wherein the resistance values are expressed in kilohms and the amplifiers are commercially available integrated circuits of the type shown. Amplifier 11 generates a zero reference voltage on an output lead 16 by summing an inverted feedback voltage with the input voltage from a voltage divider 17. Amplifier 12 generates a voltage $-V_A$ appearing on lead 17. Amplifier 14 has an input connected to output of amplifier 12 and an input connected to the output of amplifier 11 and inverts the summed input voltage and supplies it as $V_A$ on lead 18. Amplifier 13 which is connected to $-V_A$ as an input and has a feedback resistor of appropriate value produces an output $-V_A/2$ on an output lead 19. Similarly, amplifier 15 produces an output voltage $+V_A/2$ on an output lead 20.

Commercially available integrated circuits of the type indicated are connected to act as quad bilateral switches 21–26. Switches, 21, 23, 25 are actuated by the 128 Hz signal $D_1$ appearing on lead 27, while the inverted signal $D_2$ appears on lead 28 and is connected to switch devices 22, 24, 26.

The negative voltage $-V_A$ is supplied to device 26, the positive voltage $V_A$ is supplied to device 25. The positive voltages $V_A/2$ are supplied to devices 24, 21 while the negative voltages $V_A/2$ are supplied to devices 22, 23. The output from switches 21, 22 are connected to a common terminal LO-1, the outputs from devices 23, 24 are connected to a common terminal LO-2, and the output from devices 25, 26 are connected to a common terminal HI. The output from amplifier 11 is connected directly to REF.

Figure 3:
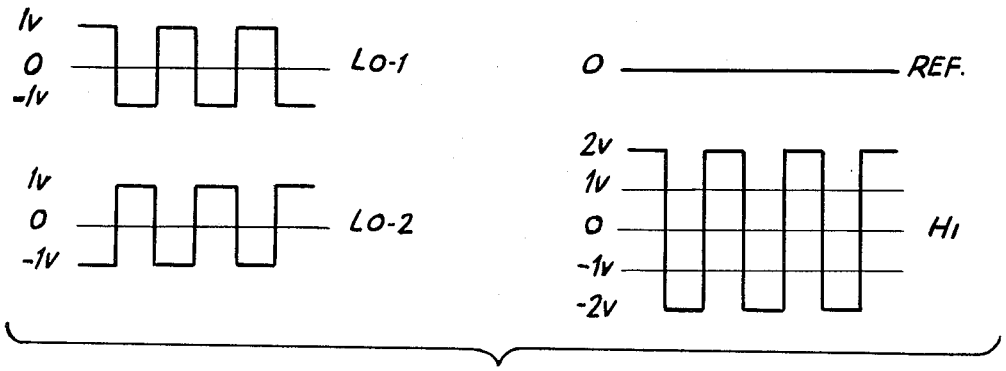

The operation of the waveform generator of FIG. 2 will be clear by reference to it and to the wave shapes shown in FIG. 3. In the embodiment shown, the voltage level $V_A$ is selected at two volts and $V_A/2$ is therefore one volt. The switching devices 21–26 are enabled by the $D_1$ and $D_2$ signals applied to leads 27, 28 to successively connect the potentials applied on leads 17–20 to the output terminals LO-1, LO-2, HI. For example, when $D_1$ is HI, devices 21, 23, 25 are enabled. A positive one volt is applied to LO-1, −1 volt is applied to LO-2, and +2 volts are applied to HI.

Reference to the waveforms shown in FIG. 3 shows that an initial time zero, these voltages appear as the first segment of the waveforms LO-1, LO-2 and HI. These are relative to the zero reference voltage on REF determined by amplifier 11.

Figure 5:
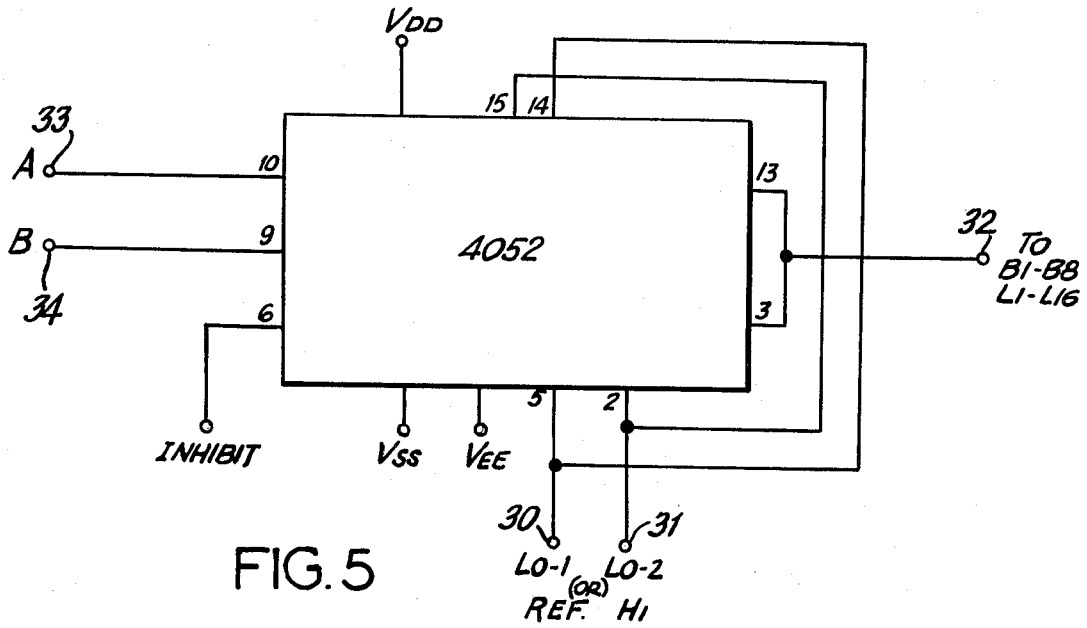

The waveforms of FIG. 3 are combined, in accordance with the present invention in an array of multiplexing switches, designated by reference 6 in FIG. 1. One of these switches is shown in FIG. 5, which may be a type 4052 CMOS multiplexer/demultiplexer, commercially available from RCA as Item CD4052AE and from others. This device, when wired as indicated in FIG. 5, will select the signal applied to either of the input terminals 30, 31 and connect it to the output terminal 32. The selection is performed by the combination of signals labeled A and B supplied to control terminals 33, 34. Input terminals 30, 31 are supplied with the correct waveforms when control signals A, B are applied. There are 24 devices such as those shown in FIG. 5, 16 of which supply either the LO-1 or LO-2 waveforms to the backplane electrodes on the display, and eight of which apply either the REF or HI waveforms to the radial electrodes on the display.

Figure 4:
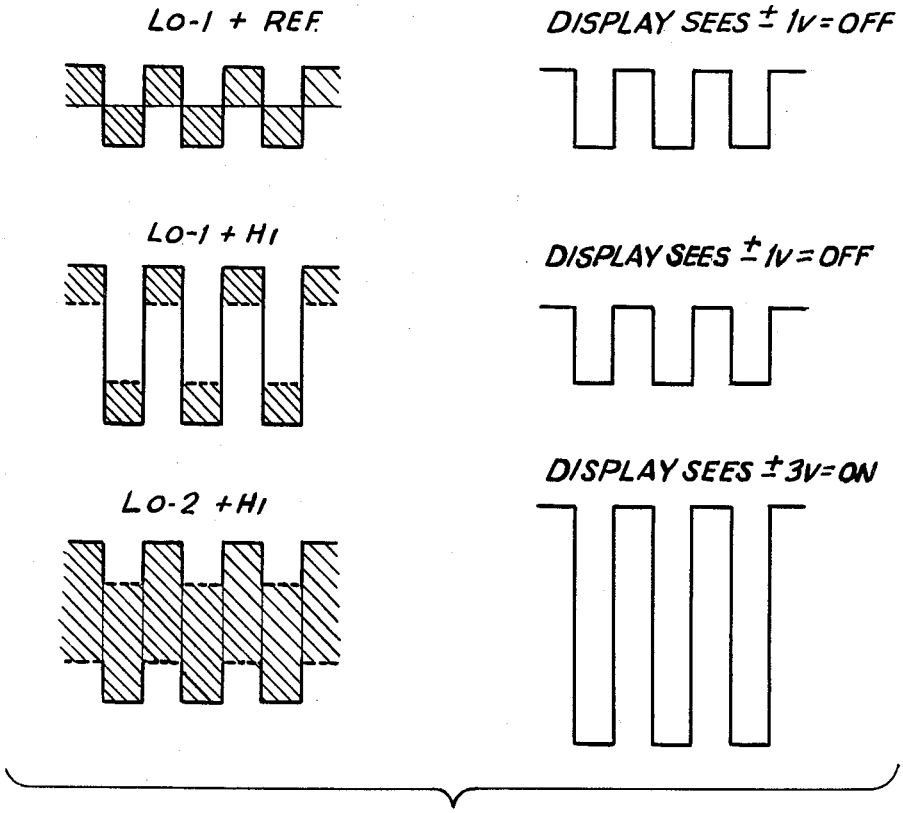

In accordance with one aspect of the present invention, the selection and combination of waveforms of FIG. 3 applied to the opposed electrodes in the liquid crystal display combine to provide an effective voltage across opposed display electrodes to make up either a low voltage square wave or a high voltage square wave. FIG. 4 illustrates the combining of waveforms LO-1 and REF, LO-1 and HI, and LO-2 and HI on the left side of FIG. 4 and on the right shows the effective waveform seen by the display. In the case of voltages selected in the preferred embodiment, the display sees plus and minus one volt for inactivated electro-optic elements and plus and minus 3 volts for activated electro-optic elements. Since liquid crystal materials have a sharp threshold, the combined low voltage square wave seen by the display is below the liquid crystal threshold voltage and the high voltage square wave is above the liquid crystal threshold. Therefore the combination of LO-2 and HI wave forms will serve to exceed the threshold voltage of the liquid crystal material and cause the display electrodes connected to LO-2 and HI to become visible in a manner known in the art. None of the other combinations of waveforms will activate opposed (or adjacent) segments (see FIG. 4).

Figure 6:
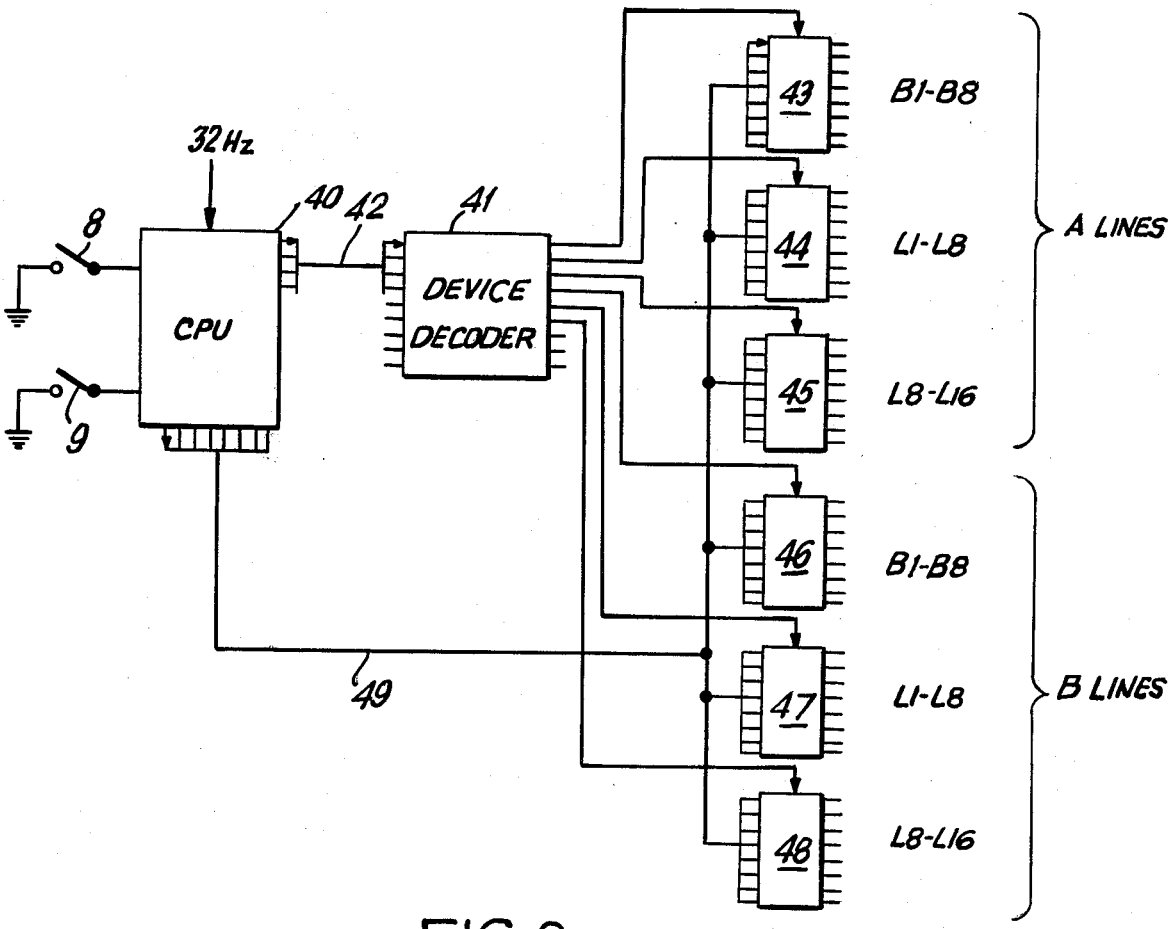

The control and sequencing of the multiplex driver 6, as well as the timekeeping and control of the overall analog LCD timepiece may be done by a microprocessor control system 7. FIG. 6 illustrates a simplified diagram of a microprocessor control system using a central processing unit (CPU) 40 having its output connected to a device decoder 41 via a four bit address bus 42. The device decoder selectively enables output latches 43–48 having data inputs connected to CPU 40 via a 8 bit data bus 49. The outputs of latches 43–45 supply the A terminals of the multiplexer drivers (see FIG. 5), while the outputs of latches 46–48 supply the B terminals.

Figure 7:
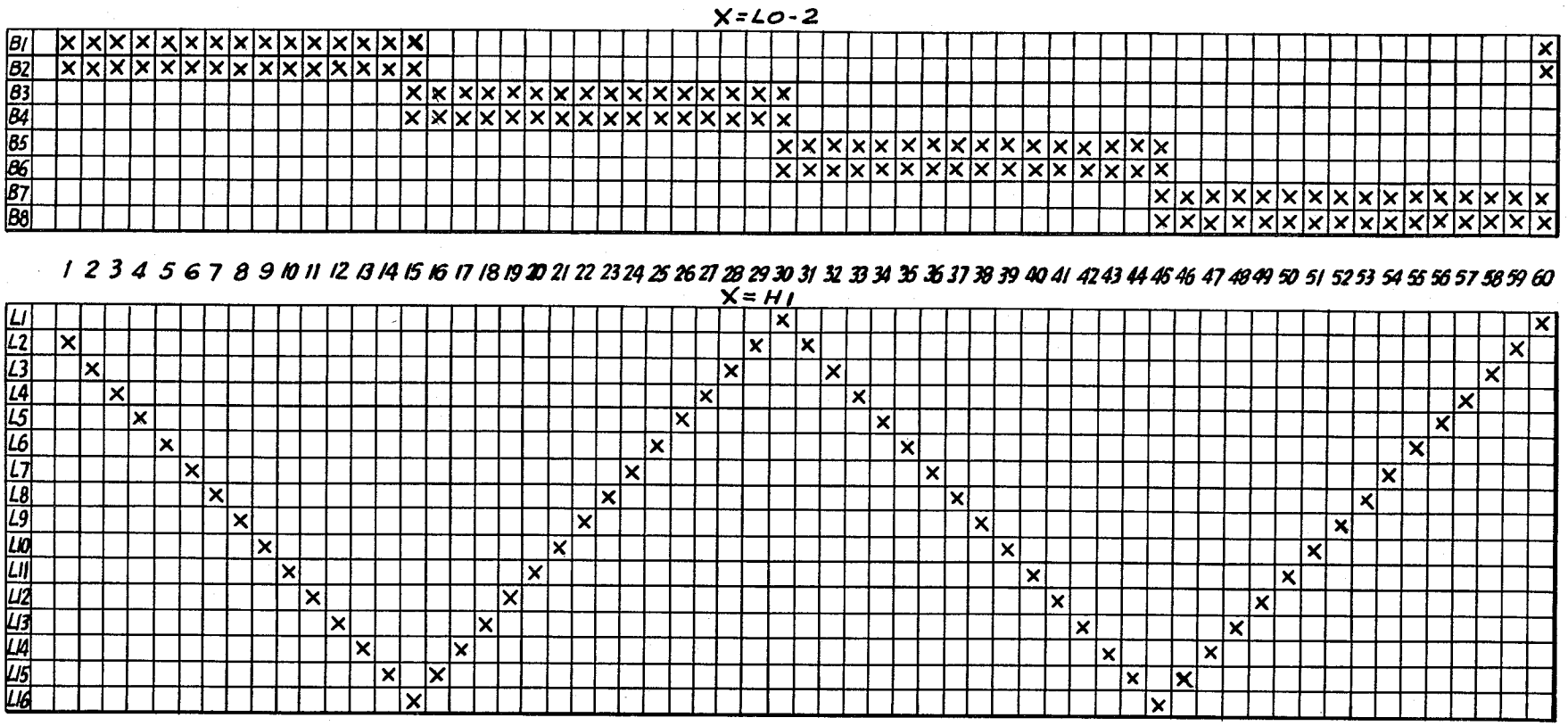
Figure 8:
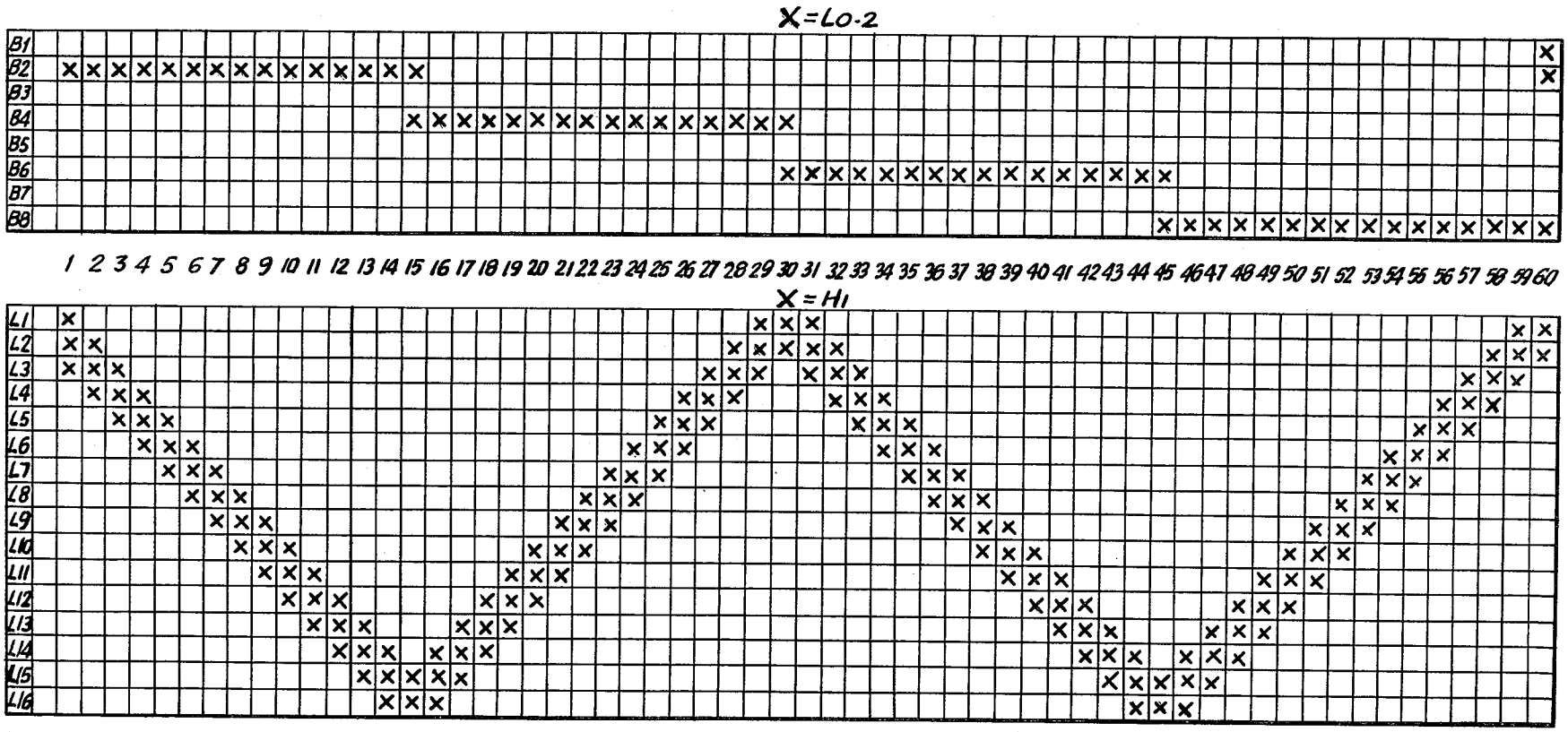
Figure 9:
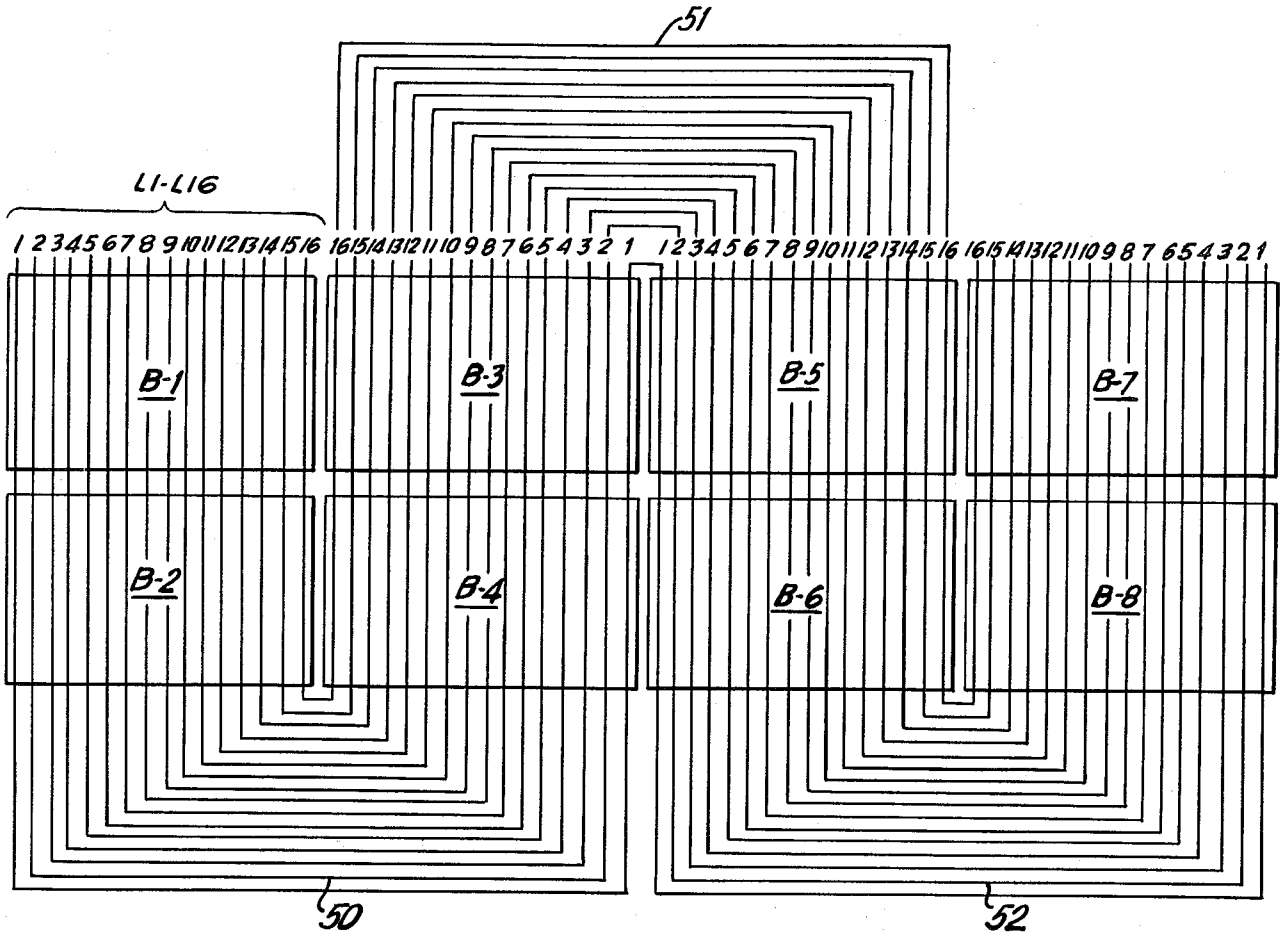

The sequence of addressing the backplane electrodes and the radial electrodes on the display appears in FIGS. 7, 8 while a developed view of the circuit matrix of electrodes appears in the developed view of FIG. 9. As indicated in FIG. 9, there are 8 backplane electrodes designated B1–B8 and there are 16 sets of strings radial electrodes designated L1–L16. As will be explained later, the backplane electrodes B1–B8 are actually shaped as inner and outer sector-shaped members covering one quadrant of the timepiece face. However, the sequencing of activated segments is clearer by referring to FIG. 9. Application of the HI waveform to any one of the L1–L6 radial sets and at the same time applying the LO-2 waveform to any one of the B1–B8 backplane electrodes will result in a visible display where the activated pair of electrodes are in physical proximity. Where multiplexing is employed, as in the present invention, successive rapid application to preselected pairs of radial and backplane segments will produce seemingly continuous visual indications at various points on the display.

Each set of radial bars or electrodes L1–L16 crosses the backplanes four separate times, once in each quadrant, this being accomplished by interconnecting lead sets 50, 51, 52, which comprise a plurality of individually separate electrical paths interconnecting the radial segments with predetermined serially connected groups, each group containing at least two radial bars.

FIG. 7 illustrates the minutes/seconds drive sequence necessary to produce a clockwise rotating minute hand and second hand. The upper portion of FIG. 7 illustrates backplane electrodes B1–B8 and the lower portion the sets of radial segments L1–L8. The horizontal intervals illustrate successive time intervals, and the Xs show application of LO-2 to the backplanes and HI to the radial segments indicated. Both inner and outer backplanes receive the LO-2 signal and only one string of radial electrodes receives the HI signal.

The successive time intervals are relative only, since naturally the sequencing of "seconds" from one position to the next along the horizontal axis takes place once per second, while the successive activation of the "minutes" from one time interval to the next along the horizontal axis takes place only once per minute.

FIG. 8 illustrates the hour's hand drive sequence in a similar manner. Only the inner backplane electrodes B2, B4, B6 and B8 are activated which determines the length of the hand, while usually three radial segments are activated which determines the width of the hand. However, in accordance with one aspect of the present invention, it will be noted that at four points in the cycle two of the backplanes are activated, while only two of the radial segments are activated.

The sequencing, multiplexing to give a visual indication of simultaneous hours, minutes and seconds hands, as well as the timekeeping and control functions are provided by the microprocessor CPU 40. In the present embodiment, these functions were programmed on an Intel 8080 microprocessor. The assembler listing for such program is incorporated herein, but it will be understood that the particular type of control system or program used is not a material aspect of the present invention.

```
                ;       ANALOG WATCH PROGRAM
                ;
                ;
                ;       VER.2.1         5-4-79
                ;
                ;
                ;
0000                    ORG 0000H
0000 C31000             JMP START
0003                    ORG 0008H
0008 C34701             JMP INT
000B                    ORG 0010H
0010 31FF33     START:  LXI SP,33FFH    ;INITIALIZE STACK POINTER
0013 CD1A00             CALL INITL
0016 FB                 EI              ;ENABLE INTERRUPT
0017 C33100             JMP LOOP1
001A 210030     INITL:  LXI H,3000H  ; INITALIZE ROUTINE
001D 011E00             LXI B,0030D
0020 70         INIT1:  MOV M,B
0021 23                 INX H
0022 0D                 DCR C
0023 C22000             JNZ INIT1
0026 210430             LXI H,HOUR
0029 360C               MVI M,12D
002B 210830             LXI H,HMSCT
002E 3601               MVI M,01D
0030 C9                 RET
0031 211530     LOOP1:  LXI H,CLOCK
0034 DB11               IN 11H
0036 E680               ANI CMASK       ;MASK UNUSED BITS
0038 47                 MOV B,A ;SAVE
0039 AE                 XRA M   ;CHECK FOR CHANGE
003A 4F                 MOV C,A
003B 70                 MOV M,B         ;NEW IN OLD
003C A0                 ANA B   ;0 TO 1 ?
003D CA4900             JZ LOOP2        ;NO
0040 CD5700             CALL TIME0
0043 CD7B00             CALL OFFSET
0046 C33100             JMP LOOP1
0049 79         LOOP2:  MOV A,C ; 1 TO 0 ?
004A B7                 ORA A
004B CA3100             JZ LOOP1        ; NO
004E CD9F00             CALL SWTMR      ;DEBOUNCE ROUTINE
0051 CDDD00             CALL SETT       ; SET ROUTINE
0054 C33100             JMP LOOP1
                        ;
                        ;
                        ;TIMEKEEPING ROUTINE
                        ;
                        ;
0057 3A0030     TIME0:  LDA CNFS1       ;SET FLAG
005A E607               ANI A
005C C0                 RNZ
005D 21E001             LXI H,TCARRY    ;MAX CNT TABLE
0060 110130             LXI D,T32CN     ;TIME REGISTER
0063 010400             LXI B,0004H
0066 1A         TIME1:  LDAX D  ;GET TIME REG.
0067 3C                 INR A
0068 12                 STAX D  ;SAVE
0069 0D                 DCR C   ;UP TO HOURS ?
```

```
006A CA7500            JZ TIME2          ;YES
006D 96                SUB M    ;CARRY ON TIME REG.
006E F8                RM       ;NO CARRY
006F 12                STAX D   ; YES RESET COUNTER
0070 13                INX D    ;NEXT TIME REG.
0071 23                INX H    ; NEXT MAX COUNTER
0072 C36600            JMP TIME1
0075 BE        TIME2:  CMP M    ;HOURS ADVANCE ?
0076 F8                RM       ; NO CARRY
0077 3E01              MVI A,01H
0079 12                STAX D   ;SAVE
007A C9                RET
                       ;
                       ;
                       ;OFFSET ROUTINE
                       ;
                       ;
007B 3A0230    OFFSET: LDA SEC
007E 320530            STA SECOFF        ; SECONDS OFFSET
0081 3A0330            LDA MIN
0084 320630            STA MINOFF        ; MINUTES OFFSET
0087 0600              MVI B,00H
0089 D60C      OFFS1:  SUI 12D
008B FA9200            JM OFFS2          ;CHECK HOURS QUAD
008E 04                INR B
008F C38900            JMP OFFS1
0092 3A0430    OFFS2:  LDA HOUR          ;HOURS OFFSET
0095 3D                DCR A
0096 4F                MOV C,A
0097 07                RLC      ;X2
0098 07                RLC      ;X4
0099 81                ADD C    ;X5
009A 80                ADD B    ;OFFSET COMPLETE
009B 320730            STA HRSOFF
009E C9                RET
009F 210930    SWTMR:  LXI H,NEWSW       ;SWITCH DEBOUNCE
00A2 DB11              IN 11H
00A4 E603              ANI SMASK         ;MASK UNUSED BITS
00A6 77                MOV M,A
00A7 0E01              MVI C,01H         ;COUNTER AND MASK
00A9 47                MOV B,A ;SWITCH STATUS
00AA 210A30            LXI H,SWWT1       ;SWITCH 1 TIMER
00AD 79        SWTR1:  MOV A,C
00AE A0                ANA B
00AF CABC00            JZ SWTR2          ;SWITCH OFF ZERO TIMER
00B2 3E02              MVI A,02H         ;MAX TIME CNT.
00B4 BE                CMP M
00B5 CACE00            JZ SWTR3          ;CONFIRM SWITCH
00B8 34                INR M
00B9 C3D500            JMP SWTR4         ;GET NEXT SWITCH
00BC AF        SWTR2:  XRA A
00BD 77                MOV M,A ;ZERO SWITCH TIMER
00BE 79                MOV A,C ;COUNTER AND MASK
00BF 2F                CMA
00C0 4F                MOV C,A
00C1 3A0030            LDA CNFS1         ;1 IF CONFIRMED, 0 IF NOT
00C4 A1                ANA C
00C5 320030            STA CNFS1
00C8 79                MOV A,C ;RESTORE MASK
00C9 2F                CMA
```

```
00CA 4F                 MOV C,A
00CB C3D500             JMP  SWTR4        ;NEXT SWITCH
00CE 3A0030    SWTR3:   LDA CNFS1
00D1 B1                 ORA C
00D2 320030             STA CNFS1         ;CONFIRMED
00D5 79        SWTR4:   MOV A,C ;COUNTER AND MASK
00D6 07                 RLC       ;NEXT SWITCH
00D7 D8                 RC        ;DONE
00D8 4F                 MOV C,A
00D9 23                 INX H     ;NEXT SWITCH TIMER
00DA C3AD00             JMP SWTR1
                        ;
                        ;
                        ;SET ROUTINE
                        ;
                        ;
00DD 210030    SETT:    LXI H,CNFS1       ;CONFIRMED SWITCHES
00E0 7E                 MOV A,M
00E1 1F                 RAR
00E2 DAEA00             JC ADV1 ;ADVANCE?
00E5 1F                 RAR
00E6 DA1B01             JC RTRD1          ;RETARD?
00E9 C9                 RET       ;NO SET
00EA 210130    ADV1:    LXI H,T32CN       ;SET TO 0
00ED 3E00               MVI A,00H
00EF 77                 MOV M,A
00F0 23                 INX H
00F1 77                 MOV M,A ;SET SEC TO 0
00F2 211330             LXI H,ADVCT       ;COUNTER
00F5 34                 INR M     ;TO CHECK FOR
00F6 7E                 MOV A,M ;EVERY 8 TIMES
00F7 D608               SUI 08H ;IS IT 8?
00F9 C0                 RNZ       ;NO
00FA 77                 MOV M,A ;YES RESET TO 0
00FB 21E201             LXI H,TCARRY+2  ;MAX COUNTER
00FE 3A0330             LDA MIN ;TIME REGISTER
0101 3C                 INR A     ;ADVANCE 1 MIN
0102 320330             STA MIN
0105 96                 SUB M
0106 F8                 RM        ;CHECK 59 TO 0
0107 AF                 XRA A     ;RESET TO 0
0108 320330             STA MIN
010B 23                 INX H     ;GET HOURS MAX CNT.
010C 3A0430             LDA HOUR
010F 3C                 INR A     ;ADVANCE HOUR
0110 320430             STA HOUR
0113 96                 SUB M     ;CHECK FOR OVER FLOW
0114 F8                 RM        ;NO OVER FLOW
0115 3E01               MVI A,01H         ;RESET
0117 320430             STA HOUR
011A C9                 RET
011B 210130    RTRD1:   LXI H,T32CN       ;SET TO 0
011E 3E00               MVI A,00H
0120 77                 MOV M,A
0121 23                 INX H
0122 77                 MOV M,A
0123 211430             LXI H,RTRCT       ;RETARD COUNTER
0126 34                 INR M     ;TO CHECK FOR
0127 7E                 MOV A,M           ;8 TIMES
```

```
0128 D608              SUI 08H
012A C0                RNZ      ;NO
012B 77                MOV M,A ;YES
012C 3A0330            LDA MIN
012F 3D                DCR A    ;DECREMENT 1 MIN.
0130 320330            STA MIN
0133 C0                RNZ      ;CHECK OVER FLOW
0134 3E3B              MVI A,59D        ;YES ,SET TO 59
0136 320330            STA MIN
0139 3A0430            LDA HOUR
013C 3D                DCR A    ;DECREMENT HOURS
013D 320430            STA HOUR
0140 C0                RNZ
0141 3E0C              MVI A,12D        ;RESET TO 12
0143 320430            STA HOUR
0146 C9                RET
                       ;
                       .
                       ;INTERUPT ROUTINE
                       ;
                       ;
0147 F5        INT:    PUSH PSW
0148 E5                PUSH H
0149 C5                PUSH B
014A D5                PUSH D
014B 210830            LXI H,HMSCT      ;OUTPUT COUNTER
014E 7E                MOV A,M
014F FE01              CPI 01H ;IS IT 1
0151 CA6101            JZ INTHRS        ;YES
0154 FE02              CPI 02H ;IS IT 2
0156 CA8A01            JZ INTMIN        ;YES
0159 FE03              CPI 03H ;IS IT 3
015B CAB301            JZ INTSEC        ;YES
015E C3DA01            JMP BCK
0161 3C        INTHRS: INR A
0162 77                MOV M,A          ;SET HMSCT TO 2
0163 3A0730            LDA HRSOFF
0166 5F                MOV E,A
0167 1600              MVI D,00H
0169 21E401            LXI H,HRS1       ;B OUT PUT SIGNALS
016C 19                DAD D
016D 7E                MOV A,M
016E D314              OUT 14H ;SEND B DATA A LINES
0170 2F                CMA
0171 D315              OUT 15H ;B LINES
0173 212002            LXI H,HRS2       ;L8 DATA
0176 19                DAD D
0177 7E                MOV A,M
0178 D312              OUT 12H          ;SEND A LINES
017A 2F                CMA
017B D313              OUT 13H          ;SEND B LINES
017D 215C02            LXI H,HRS3       ;L16 DATA
0180 19                DAD D
0181 7E                MOV A,M
0182 D310              OUT 10H          ;SEND A LINES
0184 2F                CMA
0185 D311              OUT 11H          ;SEND B LINES
0187 C3DA01            JMP BCK
018A 3C        INTMIN: INR A
018B 77                MOV M,A ;SET HMSCT TO 3
```

```
018C 3A0630          LDA MINOFF      ;GET OFFSET
018F 5F              MOV E,A
0190 1600            MVI D,00H
0192 219802          LXI H,MISE1     ;GET B DATA
0195 19              DAD D
0196 7E              MOV A,M
0197 D314            OUT 14H         ;SEND A LINES
0199 2F              CMA
019A D315            OUT 15H         ;SEND B LINES
019C 21D402          LXI H,MISE2     ;GET L8 DATA
019F 19              DAD D
01A0 7E              MOV A,M
01A1 D312            OUT 12H         ;SEND A LINES
01A3 2F              CMA
01A4 D313            OUT 13H         ;SEND B LINES
01A6 211003          LXI H,MISE3     ;GET L16 DATA
01A9 19              DAD D
01AA 7E              MOV A,M
01AB D310            OUT 10H         ;SEND A LINES
01AD 2F              CMA
01AE D311            OUT 11H         ;SEND B LINES
01B0 C3DA01          JMP BCK
01B3 3E01   INTSEC:  MVI A,01H       ;RESET HMSCT TO 1
01B5 77              MOV M,A
01B6 3A0530          LDA SECOFF      ;GET SEC. OFFSET
01B9 5F              MOV E,A
01BA 1600            MVI D,00H
01BC 219802          LXI H,MISE1     ;GET B DATA
01BF 19              DAD D
01C0 7E              MOV A,M
01C1 D314            OUT 14H         ;SEND A LINES
01C3 2F              CMA
01C4 D315            OUT 15H         ;SEND B LINES
01C6 21D402          LXI H,MISE2     ;GET L8 DATA
01C9 19              DAD D
01CA 7E              MOV A,M
01CB D312            OUT 12H         ;SEND A LINES
01CD 2F              CMA
01CE D313            OUT 13H         ;SEND B LINES
01D0 211003          LXI H,MISE3     ;GET L16 DATA
01D3 19              DAD D
01D4 7E              MOV A,M
01D5 D310            OUT 10H         ;SEND A LINES
01D7 2F              CMA
01D8 D311            OUT 11H         ;SEND B LINES
01DA D1     BCK:     POP D
01DB C1              POP B
01DC E1              POP H
01DD F1              POP PSW
01DE FB              EI
01DF C9              RET
                     ; THE FOLLOWING INFORMATION
                     ;IS THE TABLES IN ROM.
                     ;
                     ;
                     ;
01E0 20     TCARRY:  DB 32D   ; COUNTER FOR SEC.
01E1 3C     TCARSC:  DB 60D   ;MAX SEC CNT
01E2 3C     TCARMN:  DB 60D   ;MAX MIN CNT
```

```
01E3 0C          TCARHR: DB 12D  ;MAX HRS CNT
                         ;
                         ;
0003             SMASK   EQU 03H ;SWITCH MASK
0080             CMASK   EQU 80H ;CLOCK MASK
                         ;
                         ;
                         ;HRS1 IS B DATA FOR HOURS
                         ;
                         ;
01E4 08080808 HRS1:      DB 08H,08H,08H,08H,08H    ;3 OCLOCK
01E8 08
01E9 08080808            DB 08H,08H,08H,08H,08H    ;4 OCLOCK
01ED 08
01EE 08080808            DB 08H,08H,08H,08H,28H    ;5 OCLOCK
01F2 28
01F3 20202020            DB 20H,20H,20H,20H,20H    ;6 OCLOCK
01F7 20
01F8 20202020            DB 20H,20H,20H,20H,20H    ;7 OCLOCK
01FC 20
01FD 20202020            DB 20H,20H,20H,20H,0A0H   ;8 OCLOCK
0201 A0
0202 80808080            DB 80H,80H,80H,80H,80H    ;9 OCLOCK
0206 80
0207 80808080            DB 80H,80H,80H,80H,80H    ;10 OCLOCK
020B 80
020C 80808080            DB 80H,80H,80H,80H,82H    ;11 OCLOCK
0210 82
0211 02020202            DB 02H,02H,02H,02H,02H    ;12 OCLOCK
0215 02
0216 02020202            DB 02H,02H,02H,02H,02H   ;ALL HRS CHANGED
021A 02
021B 02020202            DB 02H,02H,02H,02H,0AH   ;12 OC  ;
021F 0A
                         ;
                         ; HRS2 IS THE L8-L1 DATA
                         ;
                         ;
0220 00000000 HRS2:      DB 00,00,00,00,00          ;3 OCLOCK
0224 00
0225 0080C0E0            DB 00H,80H,0C0H,0E0H,70H   ;4 OCLOCK
0229 70
022A 381C0E07            DB 38H,1CH,0EH,07H,03H     ;5 OCLOCK
022E 03
022F 070E1C38            DB 07H,0EH,1CH,38H,70H     ;6 OCLOCK
0233 70
0234 E0C08000            DB 0E0H,0C0H,80H,00,00     ;7 OCLOCK
0238 00
0239 00000000            DB 00,00,00,00,00          ;8 OCLOCK
023D 00
023E 00000000            DB 00,00,00,00,00          ;9 OCLOCK
0242 00
0243 0080C0E0            DB 00,80H,0C0H,0E0H,70H    ;10 OCLOCK
0247 70
0248 381C0E07            DB 38H,1CH,0EH,07H,03H     ;11 OCLOCK
024C 03
024D 070E1C38            DB 07H,0EH,1CH,38H,70H     ;12 OCLOCK
0251 70
0252 E0C08000            DB 0E0H,0C0H,80H,00,00     ;HRS CHANGED
```

```
0256 00
0257 00000000          DB 00,00,00,00,00          ;12 OCLOCK IS HERE
025B 00
                       ;
                       ;
                       ; HRS3 IS THE L16-L9 DATA
                       ;
                       ;
025C E0703 81C HRS3:   DB 0E0H,70H,38H,1CH,0EH    ;3 OCLOCK
0260 0E
0261 07030100          DB 07H,03H,01H,00,00       ;4 OCLOCK
0265 00
0266 00000000          DB 00,00,00,00,00          ;5 OCLOCK
026A 00
026B 00000000          DB 00,00,00,00,00          ;6 OCLOCK
026F 00
0270 00010307          DB 00,01H,03H,07H,0EH      ;7 OCLOCK
0274 0E
0275 1C3870E0          DB 1CH,38H,70H,0E0H,0C0H   ;8 OCLOCK
0279 C0
027A E0703 81C         DB 0E0H,70H,38H,1CH,0EH    ;9 OCLOCK
027E 0E
027F 07030100          DB 07H,03H,01H,00,00       ;10 OCLOCK
0283 00
0284 00000000          DB 00,00,00,00,00          ;11 OCLOCK
0288 00
0289 00000000          DB 00,00,00,00,00          ;12 OCLOCK
028D 00
028E 00010307          DB 00,01,03,07,0EH         ;HRS CHANGED
0292 0E
0293 1C3870E0          DB 1CH,38H,70H,0E0H,0C0H   ;12 OCLOCK IS HERE
0297 C0
                       ;
                       ;
                       ;MISE 1 IS THE B DATA FOR MIN AND SEC
                       ;
                       ;
0298 03        MISE1:  DB 03H            ;THIS IS 12 OCLOCK
0299 03030F            DB 03H,03H,0FH
029C 0C0C0C            DB 0CH,0CH,0CH
029F 0C0C0C            DB 0CH,0CH,0CH
02A2 0C0C0C            DB 0CH,0CH,0CH
02A5 0C0C0C            DB 0CH,0CH,0CH
02A8 0C0C3C            DB 0CH,0CH,3CH
02AB 303030            DB 30H,30H,30H
02AE 303030            DB 30H,30H,30H
02B1 303030            DB 30H,30H,30H
02B4 303030            DB 30H,30H,30H
02B7 3030F0            DB 30H,30H,0F0H
02BA C0C0C0            DB 0C0H,0C0H,0C0H
02BD C0C0C0            DB 0C0H,0C0H,0C0H
02C0 C0C0C0            DB 0C0H,0C0H,0C0H
02C3 C0C0C0            DB 0C0H,0C0H,0C0H
02C6 C0C0              DB 0C0H,0C0H
02C8 C3                DB 0C3H            ;TABLE CHANGED
02C9 030303            DB 03,03,03        ;SO THAT
02CC 030303            DB 03,03,03        ;12 OCLOCK IS ON TOP OF TABLE
02CF 030303            DB 03,03,03
02D2 0303              DB 03,03           ;THIS IS 59
                       ;
```

```
                        ;
                        ; MISE2 IS THE L8-L1 DATA FOR MIN. AND SEC.
                        ;
                        ;
02D4 00        MISE2:   DB 00              ;THIS IS 12 OCLOCK (0MIN)
02D5 000000             DB 00,00,00
02D8 000000             DB 00,00,00
02DB 000000             DB 00,00,00
02DE 008040             DB 00,80H,40H
02E1 201008             DB 20H,10H,08H
02E4 040201             DB 04H,02H,01H
02E7 020408             DB 02,04,08
02EA 102040             DB 10H,20H,40H
02ED 800000             DB 80H,00,00
02F0 000000             DB 00,00,00
02F3 000000             DB 00,00,00
02F6 000000             DB 00,00,00
02F9 000000             DB 00,00,00
02FC 008040             DB 00,80H,40H
02FF 201008             DB 20H,10H,08H
0302 0402               DB 04,02
0304 01                 DB 01               ;TABLE WAS CHANGED
0305 020408             DB 02H,04H,08H      ;SO THAT 12 OCLOCK
0308 102040             DB 10H,20H,40H      ;IS TOP OF TABLE
030B 800000             DB 80H,00,00
030E 0000               DB 00,00            ;THIS IS 59 MIN
                        ;
                        ;
                        ; MISE3 IS THE L16-L9 DATA
                        ;
                        ;
0310 10        MISE3:   DB 10H             ;THIS IS 12 OCLOCK
0311 204080             DB 20H,40H,80H
0314 402010             DB 40H,20H,10H
0317 080402             DB 08H,04H,02H
031A 010000             DB 01,00,00
031D 000000             DB 00,00,00
0320 000000             DB 00,00,00
0323 000000             DB 00,00,00
0326 000000             DB 00,00,00
0329 000102             DB 00,01,02
032C 040810             DB 04,08,10H
032F 204080             DB 20H,40H,80H
0332 402010             DB 40H,20H,10H
0335 080402             DB 08,04,02
0338 010000             DB 01,00,00
033B 000000             DB 00,00,00
033E 0000               DB 00,00
0340 00                 DB 00               ;TABLE WAS CHANGED
0341 000000             DB 00,00,00         ;SO THAT 12 OCLOCK
0344 000000             DB 00,00,00         ;IS ON TOP OF TABLE
0347 000102             DB 00,01,02
034A 0408               DB 04H,08H          ;THIS IS 59 MIN
                        ;
                        ;
                        ;RAM STARTS HERE
                        ;
                        ;
034C                    ORG 3000H
3000           CNFS1:   DS 1
```

```
3001        T32CN:   DS 1
3002        SEC:     DS 1
3003        MIN:     DS 1
3004        HOUR:    DS 1
3005        SECOFF:  DS 1
3006        MINOFF:  DS 1
3007        HRSOFF:  DS 1
3008        HMSCT:   DS 1
3009        NEWSW:   DS 1
300A        SWWT1:   DS 8
3012        NCNFS:   DS 1
3013        ADVCT:   DS 1
3014        RTRCT:   DS 1
3015        CLOCK    :DS 1
0000                 END
```

memory locations and successive time intervals correspond to FIG. 7. Lastly, a number of RAM memory locations are illustrated for variable data storage including the current time SEC, MIN, HOUR.

Figure 10:
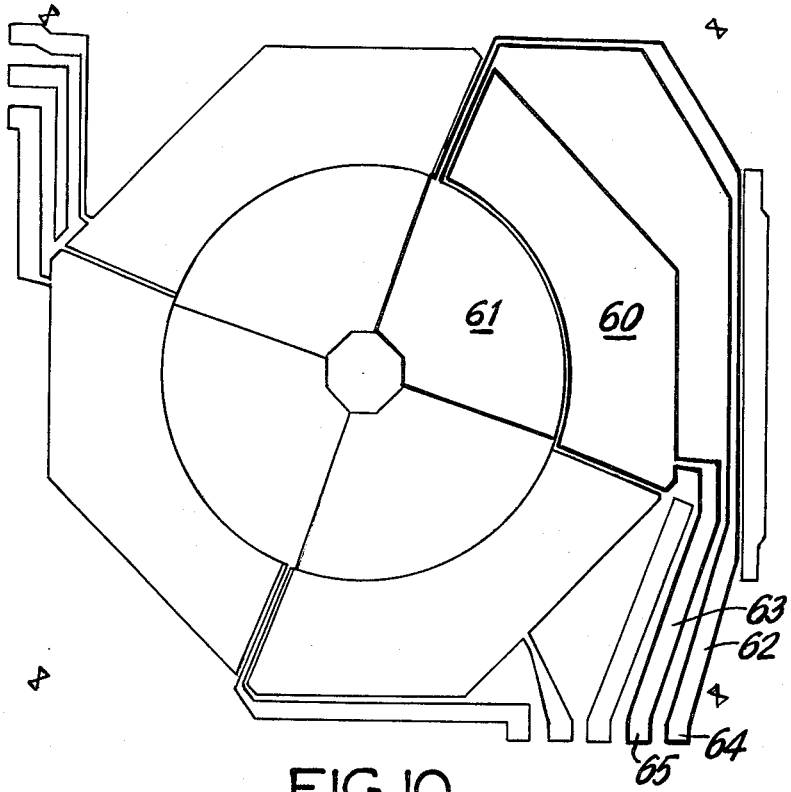
Figure 11:
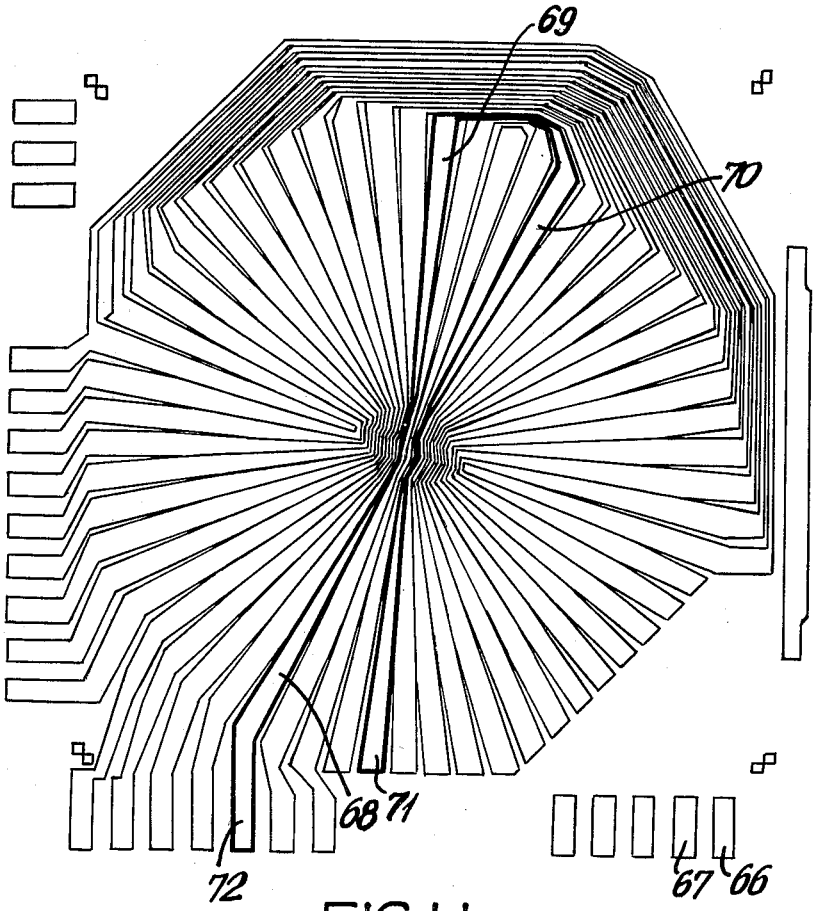

FIG. 10 and FIG. 11 are plan views of the backplane electrode and radial electrode layouts on the back and front substrates respectively. The conductor patterns are applied by conventional photographic techniques on transparent conductive substrates and etched to provide the conductive electrode patterns shown. One of the patterns shown is reversed. The backplane electrodes, FIG. 10 are elements disposed in annular groups, are generally sector shaped and here cover one quadrant. Each of the outer sectors, such as 60 and each of the inner sectors, such as 61, is connected by a lead 62, 63 respectively to crossover terminals, 64, 65, which provide means for individually applying electrical potentials thereto.

Referring to FIG. 11, each of the crossover terminals, 64, 65 of FIG. 10 has an aligned contact terminal 66, 67

A brief explanation of the program is as follows: timekeeping is provided by the program portions LOOP 1, LOOP 2, TIME 0, TIME 1, and TIME 2, which count the 32 Hz pulses and produce electrical signals varying with time at predetermined rates and represent counts of seconds, minutes and hours. These signals advance the time data kept in the RAM portion of the computer memory. The subroutines OFFSET, SWTMER, SETT, ADV 1 AND RTD 1 are concerned with various housekeeping functions and control by the external switches which are not material to the present invention. The interrupt routines, INT, INTHRS, INTMIN, INTSEC accomplish the multiplexing of the display of hours, minutes and seconds on a time shared basis by successively selecting the proper output devices and sending other output signals termed A and B signals to the multiplex drivers which activate the proper display electrode at the proper time and in the proper time sequence.

The data for the B1–B8 and L1–L16 sequence of activating electrodes for "hours" is stored in the computer memory at the locations indicated by HRS 1, HRS 2 and HRS 3. This corresponds to successive sequences and successive memory locations shown in FIG. 8. The B1–B8 data and the L1–L16 data for the activating sequence of both minutes and seconds is stored at successive memory locations in three groups called MISE 1, MISE 2, MISE 3. These successive on FIG. 11 respectively, which provide a bridge when they are interconnected so that all of the display terminals will be located on one substrate for ease of connection. Still referring to FIG. 11. The radial elements radiate from near the central point of the display and define radial bars, which are disposed in cooperative relationship with the back plane sectors, and have electrical leads connecting them in series in sets or strings. Each of the radial electrode sets, such as L3, includes four radial segments such as 68, 69, 70, 71, one of which crosses each inner and outer backplane sector. Each one of the strings of radial segments such as 68–71 is lead out to a contact terminal 72. If the designated contact terminals 66, 67 receive a HI waveform, this will be applied to backplanes 60, 61. If at the same time, terminal 72 receives a HI waveform, this will be applied to radial electrodes, 68, 69, 70, 71. Assuming that radial electrode 70 is disposed opposite backplanes 60, 61, segment 70 will become visible as indicated by the shading on FIG. 11. The remainder of the backplane/radial electrode pairs will receive effective square wave voltages only $\frac{1}{3}$ of those applied to the indicated terminals and hence will not be activated.

Figure 12:
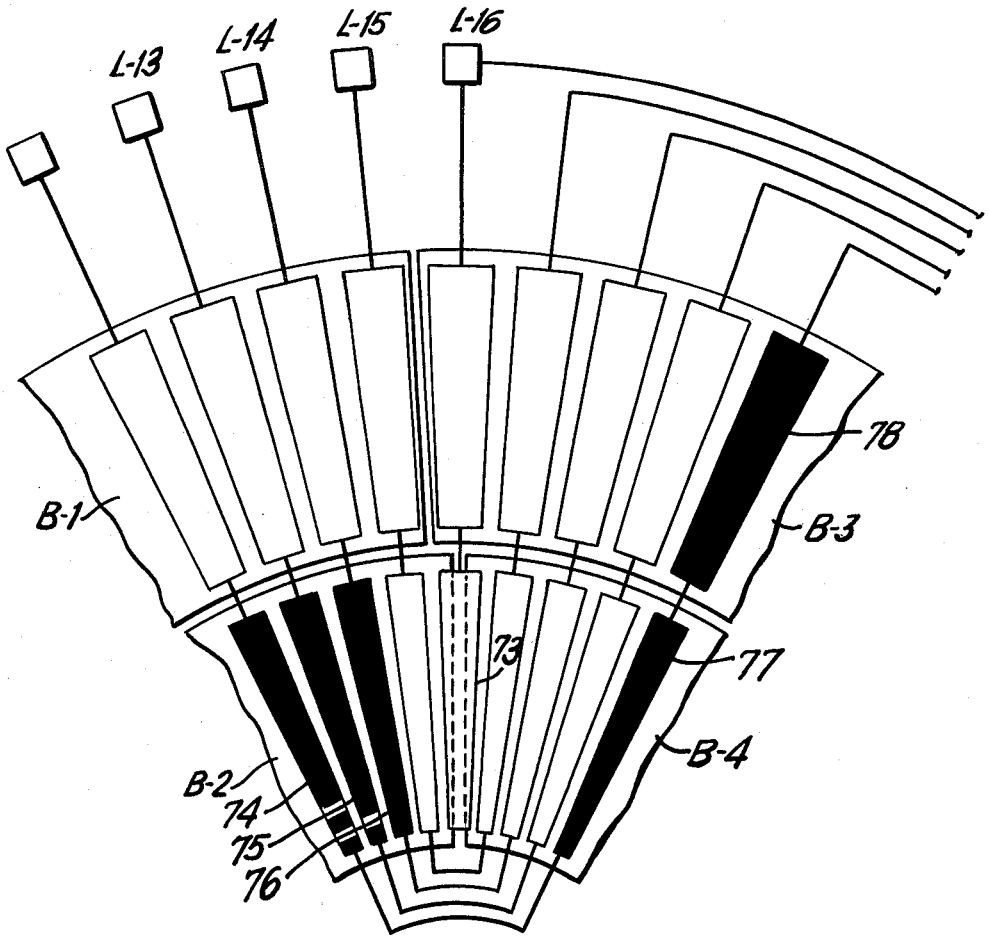

It remains to note that, as shown in FIG. 10, the backplanes are closely spaced at the juncture and the backplane junctures are slightly angularly offset between the inner and outer backplanes. The purpose of this will be clear by reference to FIG. 12 showing an enlarged view of one portion of the display at the juncture between backplane quadrants.

In accordance with another aspect of the invention, some of the radial segments are arranged to "straddle" the juncture between inner backplanes. The clearances shown in FIG. 12 are greatly exaggerated for purpose of explanation, and the inner and outer radial electrodes also being separated although in actuality they appear as shown in FIG. 11. In the preferred embodiment, the inner part of radial segment 73 straddles the inner backplanes, so that $\frac{1}{2}$ of the segment lies over each of the backplanes. Thus $\frac{1}{2}$ of the segment can be activated by appropriate driving voltage combinations, or both halves of the segment.

In the present driving scheme, an hour hand is represented by three inner radial segments as illustrated by darkened segments 74, 75 and 76, while a minute hand is represented by a long single-width segment represented by the darkened radial elements 77, 78. This arrangement provides a smooth transition between hour hand and minute hand during crossover as well as visually distinguishing between hour hand and minute hand.

In the first place, the use of three radial segments (or any odd number) allows the segments to overlap on either side of the narrow minute hand segment by equal amounts. This permits the minute and hour hand to both point directly at the same market, as in the straight up 12 o'clock position. In the second place, the use of the special straddling segment allows continuous sequencing of the hour hand at the juncture without requiring the hour hand to wait and then jump over the juncture or, alternatively, without requiring an increase in the multiplex level.

Figure 12A:
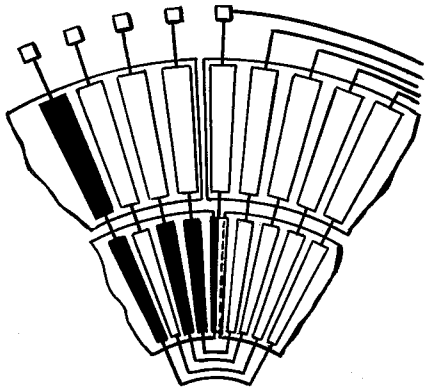
Figure 12B:
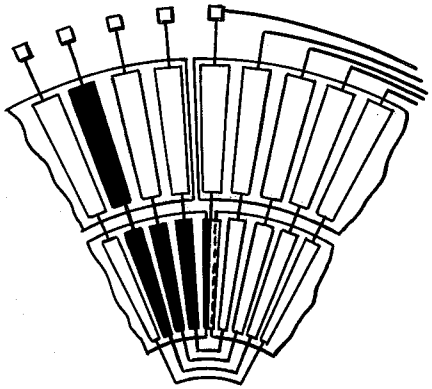
Figure 12C:
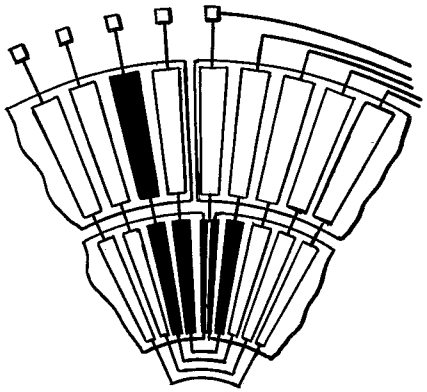
Figure 12D:
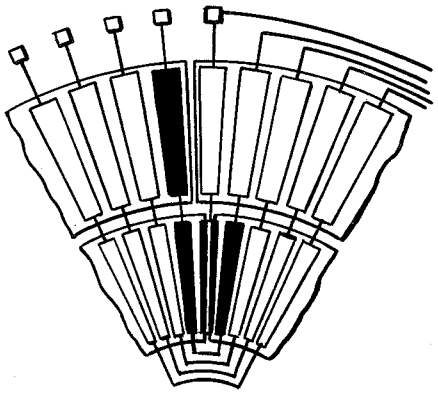
Figure 12E:
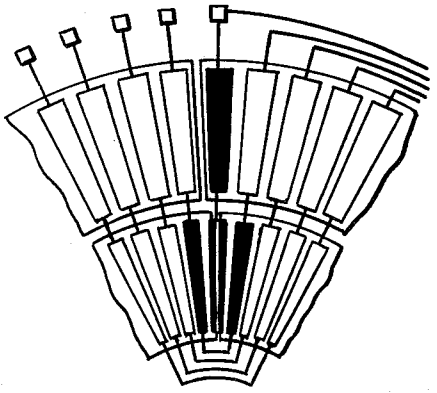
Figure 12F:
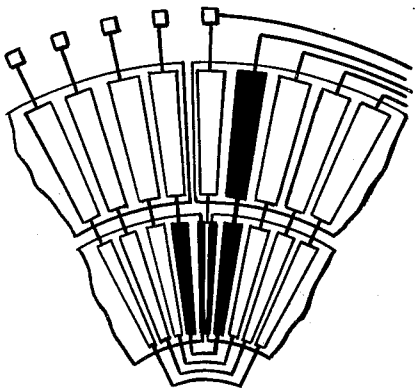
Figure 12G:
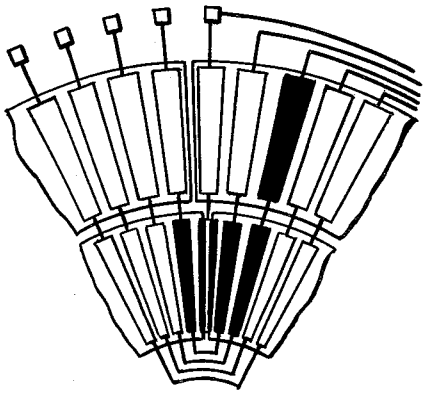
Figure 12H:
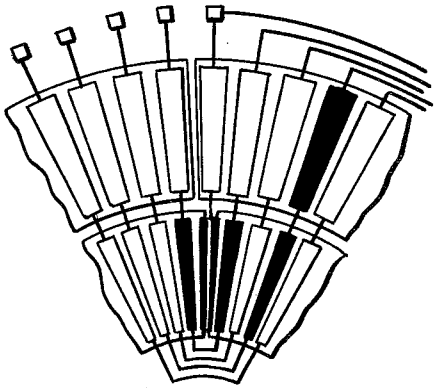

The operation of the invention using the special straddling radial segment is shown in the sequence of FIGS. 12*a* –12*i*. As the hour hand approaches the junction, the normal three-segment wide hand is reduced to 2½ segments wide as shown in FIGS. 12*a* and 12*b*. The hour hand is advanced every twelve minutes to a new radial position. In FIGS. 12*c*–*12h*, both halves of the straddling segment are activated, as well as the segment on either side of it. Twelve minutes later, the inner hand again reduces to 2½ segments and twelve minutes later it reverts to a normal three segment wide marker (not shown). Normally, there would be 15 leads needed for radial strings in 4 quadrants in order to show sixty positions, but the present invention uses 16 leads to accomplish the special crossing of the backplane juncture. This does not cause any problem because it still allows driving the LCD analog from an 8×16 driving matrix which fits into standard 8 bit microcomputer architecture and with little loss of visual perception of hour hand width.

In conclusion, the invention offers a number of advantages comprising a novel conductor lead configuration for producing "hand" shaped elements in an analog type crystal display. The configuration allows for a continuous propogation of a multisegment "hand" around the face of the timepiece as well as a simple and straightforward drive sequence and waveform for the energization of the liquid crystal display. The following advantages are achieved with the described arrangement.

1. Continuous sequencing of a "hand" which is more than two segments wide.
2. Very little visual distortion at the juncture between backplanes.
3. An hour hand which can point directly at a major hour marker with a centered minute hand.
4. Simple, straightforward driving of the display by simple wave forms with repetitive up-down sequencing due to a 16×8 radial segment/backplane segment arrangement.
5. A minimum number of electrical waveforms are needed.
6. Multiplexing for visual perception of a continuously moving second hand, hour hand and minute hand.

Although the controlling and driving circuitry for the LCD analog timepiece has been described in terms of separate commercially available components and integrated circuits, with a standard microprocessor and associated program, the entire multiplexing drive circuit, timekeeping oscillator with countdown dividers, waveform generator and multiplexers can easily be implemented on a single integrated circuit chip by means known to those skilled in the art.

While other modifications of the invention will become apparent to those skilled in the art, it is desired to cover in the appended claims all such modifications as fall within the true spirit and scope of the invention.

What is claimed is:

1. An LCD analog timepiece comprising (a) a time base including a quartz oscillator and countdown divider chain providing timekeeping pulses of a first frequency and display driving pulses of a second frequency, (b) a liquid crystal analog display comprising a plurality of backplane electrodes on one substrate and a plurality of radial electrodes on the other substrate connected in strings, whereby each string of radial electrodes traverses all of the backplane electrodes, (c) a waveform generator connected to receive said second frequency pulses and providing four output waveforms, one pair of which when combined will activate opposed electrodes in said liquid crystal display and any other combination of which will not activate the display electrodes, (d) a multiplexer connected to receive the plurality of waveforms and to sequentially supply selected waveform combinations to the display backplanes and radial sets in pairs, and (e) timekeeping and control means for counting the first frequency pulses and activating the multiplexer so as to sequentially apply selected activating combinations of waveforms to display electrodes causing the radial segments to display the time.

2. The combination according to claim 1 wherein said liquid crystal display has a plurality of first conductive electrodes on one substrate and a plurality of second conductive electrodes on an opposed substrate, said wave generator comprising:

(a) first means generating a first reference voltage waveform, (b) second means generating a second wave form varying periodically between a pre-selected high positive and negative voltage with respect to the reference voltage, (c) third means generating a third waveform varying periodically between a pre-selected low positive and negative voltage with respect to the reference voltage, and in the same phase relationship to the second waveform, (d) fourth means generating a fourth waveform varying periodically between said low positive and negative voltage and in inverse phase relationship to the second waveform, and wherein said multiplexer is adapted to selectively apply the first and second waveforms to said first electrodes and to selectively apply the third and fourth waveforms to said second electrodes, whereby the first and second electrodes connected to the second and fourth waveforms see an effective voltage between them equal to the difference between a high and low voltage of opposite polarity, while other segments all see the difference between the high and low voltage of the same polarity.

3. The combination according to claim 2, wherein the high voltage is selected to be two times the low voltage, whereby the voltage seen by the first and second electrodes is three times the voltage seen by the remaining electrodes.

4. The combination according to claim 1 wherein said analog liquid crystal display includes a plurality of sector-shaped conductor backplanes on one display substrate and a plurality of strings of radial conductive electrodes disposed on the other substrate, said radial electrodes in each of the strings being connected in series and spaced so that each string of the radial electrodes traverses all of the sector-shaped backplane electrodes on the other substrate, said display comprising at least one radial electrode disposed to "straddle" the juncture between adjacent backplane electrodes, whereby either half or both halves of the radial electrode may be activated for visually indicating either half a radial element or all of a radial element.

5. The combination according to claim 4 wherein there are 16 strings of radial electrodes, 8 backplane and electrodes and arranged in inner and outer sectors extending over one quadrant.

6. The combination according to claim 5 wherein the inner quadrant junctures are angularly offset with respect to two outer quadrant junctures and wherein said radial electrode straddles only the juncture between inner backplanes.

7. In combination, an electro-optic display having a first layer of display elements disposed in configuration radiating from near the central point of the display and defining radial bars, a second layer of elements disposed in cooperative relationship with said first layer, said second layer of elements being disposed in a plurality of annular concentric groups operatively associated with said radial bars, a first plurality of individually separate electrical paths interconnecting said elements of said first layer into predetermined serially connected groups, each group containing at least two of said radial bars, a second plurality of electrical conductors separately connected to the elements of said second layer and providing means for individually applying electrical potentials thereto, electronic circuitry for driving said display elements comprising a source of electrical signals having predetermined repetition rates, countdown mean connected to said source for producing first and second frequency electrical signals varying with time at predetermined rates, a waveform generator connected to receive the second frequency signals and to provide first and second subsets of waveforms each having no more than two discrete voltage levels, a multiplexer connected to receive the waveforms and apply pairs of waveforms to said display elements, only one of said pairs serving to activate the elements, and timekeeping and control means for counting the first frequency signals to store time information in hours, minutes and seconds and activating the multiplexer so as to sequentially apply the activating pair of waveforms to the elements to display the time.

8. The combination according to claim 7, wherein selected radial bars straddle selected elements in said second layer.

9. The combination according to claim 7 wherein the voltage level in one subset of waveforms is double the voltage level in the other subset.

10. An LCD analog timepiece comprising (a) a time base including a quartz oscillator and countdown divider chain providing timekeeping pulses of a first frequency and display driving pulses of a second frequency, (b) a liquid crystal analog display comprising a plurality of backplane electrodes on one substrate and a plurality of radial electrodes on the other substrate connected in strings, whereby each string of radial electrodes traverses all of the backplane electrodes and where at least one radial electrode straddles two annularly grouped juxtaposed backplane electrodes, (c) a waveform generator connected to receive said second frequency pulses and providing four output waveforms, one pair of which when combined will activate opposed electrodes in said liquid crystal display and any other combination of which will not activate the display electrodes, (d) a multiplexer connected to receive the plurality of waveforms and to sequentially supply selected waveform combinations to the display backplanes and radial sets in pairs, and (e) timekeeping and control means for counting the first frequency pulses and activating the multiplexer so as to sequentially apply selected activating combinations of waveforms to display electrodes causing the radial segments to display the time.

* * * * *